US008037869B2

(12) United States Patent
Ricco et al.

(10) Patent No.: US 8,037,869 B2
(45) Date of Patent: Oct. 18, 2011

(54) FUEL INJECTOR WITH BALANCED METERING SERVOVALVE FOR AN INTERNAL-COMBUSTION ENGINE

(75) Inventors: Mario Ricco, Casamassima (IT); Raffaele Ricco, Valenzano (IT); Sergio Stucchi, Valenzano (IT); Onofrio De Michele, Valenzano (IT); Marcello Gargano, Valenzano (IT); Domenico Lepore, Valenzano (IT); Carlo Mazzarella, Valenzano (IT)

(73) Assignee: C.R.F. Societa Consortile per Azioni, Orbassano (IT)

( * ) Notice: Subject to any disclaimer, the term of this patent is extended or adjusted under 35 U.S.C. 154(b) by 308 days.

(21) Appl. No.: 12/491,329

(22) Filed: Jun. 25, 2009

(65) Prior Publication Data

US 2009/0320800 A1 Dec. 31, 2009

(30) Foreign Application Priority Data

Jun. 27, 2008 (EP) ..... 08425458

(51) Int. Cl.
*F02M 51/00* (2006.01)

(52) U.S. Cl. ..... 123/472; 123/490; 239/585.3; 251/129.16

(58) Field of Classification Search ..... 123/472, 123/478, 490; 251/129.02, 129.15, 129.16; 239/585.3, 585.4, 585.5
See application file for complete search history.

(56) References Cited

U.S. PATENT DOCUMENTS

| | | | | |
|---|---|---|---|---|
| 5,203,538 | A | 4/1993 | Matsunaga et al. | |
| 5,820,101 | A | 10/1998 | Ricco | |
| 6,109,541 | A | 8/2000 | Beatty et al. | |
| 6,315,531 | B1 | 11/2001 | Schwarz | |
| 7,013,876 | B1 | 3/2006 | Puckett et al. | |
| 7,513,445 | B2 | 4/2009 | Ricco et al. | |
| 7,954,787 | B2 * | 6/2011 | Ricco et al. | 251/129.16 |
| 2009/0320801 | A1 | 12/2009 | Ricco et al. | |
| 2010/0162992 | A1 | 7/2010 | Ricco et al. | |
| 2010/0186708 | A1 | 7/2010 | Ricco et al. | |

FOREIGN PATENT DOCUMENTS

| | | |
|---|---|---|
| DE | 198 20 341 A1 | 5/1998 |
| DE | 10 2004 050 992 A1 | 4/2006 |
| EP | 0690958 | 1/1996 |

(Continued)

OTHER PUBLICATIONS

European Search Report dated Nov. 2, 2009, as issued in application No. 08173039.2-1263.

(Continued)

*Primary Examiner* — Hai Huynh
(74) *Attorney, Agent, or Firm* — Workman Nydegger

(57) ABSTRACT

The injector comprises a balanced metering servovalve for controlling a rod for opening/closing a nebulizer. The servovalve has a valve body having a control chamber provided with an outlet passage that is opened/closed by an axially mobile open/close element. The open/close element is made of a single piece with a bushing separate from an armature plate of an electromagnet. The bushing is coupled to a stem in an axially slidable way for closing an exhaust duct in communication with the outlet passage The open/close element is kept in a closed position by a spring that acts upon the bushing through an intermediate body connected thereto. The armature plate can be displaced with respect to the bushing between a flange of the intermediate body and a shoulder of the bushing, for eliminating the rebounds of the open/close element upon closing of the servovalve.

30 Claims, 10 Drawing Sheets

FOREIGN PATENT DOCUMENTS

| | | | |
|---|---|---|---|
| EP | 0 851 116 | A2 | 7/1998 |
| EP | 0851114 | A | 7/1998 |
| EP | 1045135 | A | 10/2000 |
| EP | 1820958 | A | 8/2007 |
| EP | 1 916 414 | A2 | 4/2008 |
| EP | 1 918 568 | A1 | 5/2008 |
| JP | 2010007667 | | 1/2010 |

OTHER PUBLICATIONS

U.S. Appl. No. 12/491,345, Feb. 23, 2011, Notice of Allowance.

European PO; search report in foreign application (EP 08425458.0) to which priority is claimed by the present application; Nov. 28, 2008.

U.S. Appl. No. 12/491,345, Aug. 20, 2010, Office Action.

* cited by examiner

FUEL INJECTOR WITH BALANCED METERING SERVOVALVE FOR AN INTERNAL-COMBUSTION ENGINE

CROSS-REFERENCE TO RELATED APPLICATIONS

This application is related to the following: U.S. patent application Ser. No. 12/491,345 filed Jun. 25, 2009.

This application claims priority to European Patent Application No. 08425458.0 filed on 27 Jun. 2008, the disclosure of which is incorporated herein, in its entirety, by this reference.

BACKGROUND

1. Technical Field

One or more embodiments of the present invention relate to a fuel injector with balanced metering servovalve for an internal-combustion engine, in which the servovalve governs a control rod for controlling injection.

2. The Relevant Technology

Normally, the metering servovalve of the injector comprises a control chamber having a calibrated hole for intake of the fuel under pressure. The control chamber is provided with an outlet or exhaust hole having a calibrated section, which is opened/closed by an open/close element that is axially mobile under the control of an electro-actuator. In particular, the exhaust hole is kept closed by the open/close element under the action of a spring, which acts upon an armature of an electromagnet. The exhaust hole is opened when the armature is actuated by the electromagnet, overcoming the action of the spring.

As long as the exhaust hole is closed, the pressure of the fuel in the control chamber, via the rod, keeps a needle of a nozzle or nebulizer for the fuel in a closed position. When the exhaust hole is open, the pressure of the fuel in the control chamber decreases, while the pressure in the usual injection chamber displaces the needle for opening the nebulizer to thereby displace the rod in the control chamber.

In known injectors, during closing of the needle of the nebulizer, upon arrest of the travel of the needle there occurs a rebound that causes a sort of re-opening of the nebulizer just after closing. This brings about a variation in the gradient of increase in the volume of the control chamber, and hence in the corresponding pressure, or even a temporary decrease in said volume. Furthermore, also the open/close element of the servovalve is subject to a rebound during closing of the hole for exhaust of the control chamber, this also causing a re-opening of said chamber and hence a temporary decrease in the pressure and consequently in the corresponding volume, thus increasing re-opening of the nebulizer.

The re-opening of the nebulizer and/or of the exhaust hole of the control chamber, due to the aforesaid rebounds, always causes injection of an amount of fuel greater than what is envisaged by the usual electronic control unit for controlling injection. On account of the large number of factors that affect the rebounds, the excess fuel thus introduced is not foreseeable so that it is not possible compensate for it via the electronic control unit, for example, by introducing a corrective factor for the time of excitation of the electromagnet. Consequently, especially during idling of the engine, the excess fuel causes a variation in the air/fuel ratio, which moves away from the optimal one, causing at the exhaust an excess of polluting emissions in the environment.

There have already been proposed injectors with a metering servovalve of a balanced type, in which the open/close element in a closed position is subject to substantially zero axial actions of pressure so that it is possible to reduce both preloading of the spring and the force of the electro-actuator. In a known balanced metering servovalve, the valve body comprises an axial stem, which is provided with an exhaust duct of the control chamber and is designed to guide the armature of the electromagnet axially. The open/close element is formed by a bushing engaging in a fluid-tight way with the stem, which is fixed with respect to the armature.

The exhaust duct of the control chamber comprises an axial stretch and at least one radial stretch, which gives out onto a lateral surface of the stem. Since the armature is in general in the form of a plate, or notched disk and is made of a single piece with the bushing, the moving element of the electro-actuator has a considerable mass, and is thus subject to considerable rebounds during closing, with a very low reactivity.

Furthermore, since the bushing must form a seal with the lateral surface of the stem and the open/close element must close the exhaust duct via engagement with an arrest element, the bushing must be machined with extreme precision and be made of a very hard material. The entire bushing-armature plate ensemble must hence be made of said hard material so that, on the one hand, there is a lot of swarf of said material and, on the other, machining thereof is very difficult and costly.

In this servovalve, even though the travel of the open/close element is just a few microns, the forces and the accelerations involved, to which it is subject, can lead to an inevitable rebound of the open/close element during closing. In turn, the marked hardnesses of the parts and the small surfaces, which are in contact along a ring of a width of 1-2 hundredths of a millimeter, favor said rebound, causing a re-opening and a corresponding emptying of the volume of the control chamber.

SUMMARY

The aim of one or more embodiments of the invention is to provide a fuel injector with balanced servovalve for an internal-combustion engine, in which the servovalve enables a high reactivity of the servovalve to be obtained, eliminating the drawbacks referred to above.

The above aim may be achieved by a fuel injector with a balanced metering servovalve for an internal-combustion engine.

BRIEF DESCRIPTION OF THE DRAWINGS

For a better understanding, some of the embodiments of the present invention are described herein, purely by way of non-limiting example, with the aid of the annexed drawings, wherein.

DETAILED DESCRIPTION

Figure 1:
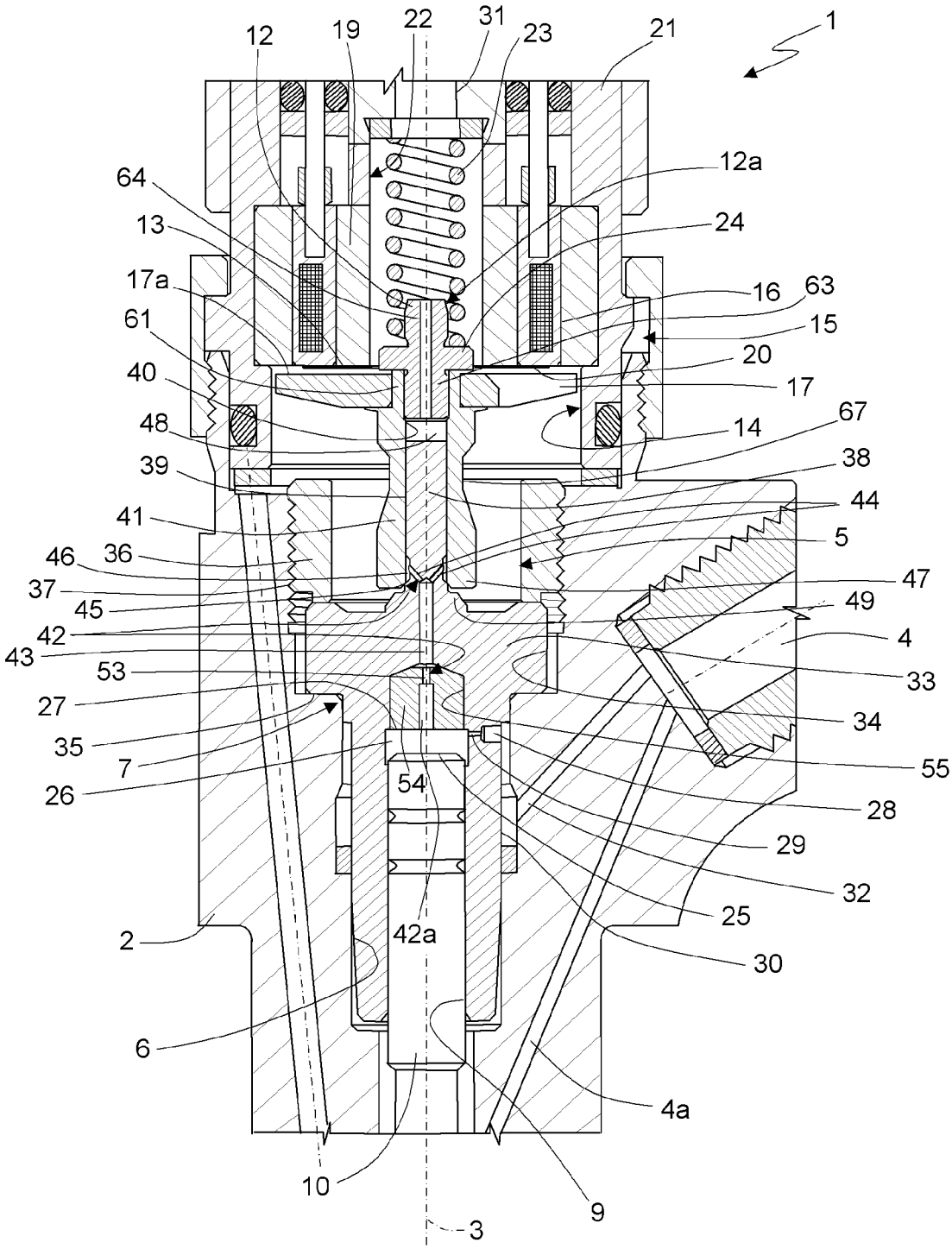
FIG. 1 is a partial vertical cross section of a fuel injector with a balanced servovalve for an internal-combustion engine, according to a first embodiment of the invention.

With reference to FIG. 1, designated as a whole by 1 is a fuel injector for an internal-combustion engine, in particular a diesel engine. The injector 1 comprises a hollow body or casing 2, which extends along a longitudinal axis 3, and has a side inlet 4, designed to be connected to a duct for delivery of the fuel at a high pressure, for example, at a pressure in the region of 1800 bar. The casing 2 terminates with a nozzle, or injection nebulizer (not visible in the figures), which is in communication with the inlet 4, through a duct 4*a*.

The casing 2 has an axial cavity 6 in which a metering servovalve 5 comprising a valve body 7 having an axial hole 9 is disposed. A control rod 10 for controlling injection of the fuel under pressure is able to slide axially in the hole 9 in a fluid-tight way. The casing 2 is provided with another cavity 14, which is coaxial with the cavity 6 and houses an electro-actuator 15. The electro-actuator 15 comprises an electromagnet 16 designed to control an armature plate 17 in the form of a notched disk. In particular, the electromagnet 16 comprises a magnetic core 19, which has a polar surface 20 perpendicular to the axis 3, and is kept in position by a support 21.

The electro-actuator 15 has an axial cavity 22 in communication with the exhaust of the servovalve 5 towards the usual fuel tank. Housed in the cavity 22 are elastic means defined by a helical compression spring 23. The spring 23 is pre-loaded so as to exert an action of thrust on the armature plate 17, in a direction opposite to the attraction exerted by the electromagnet 16 when it is excited. The spring 23 acts upon the armature plate 17 through an intermediate body, designated as a whole by 12*a*, which comprises engagement means formed by a flange 24 made of a single piece with a guide pin 12 of one end of the spring 23. Set between a plane top surface 17*a* of the armature plate 17 and the polar surface 20 of the core 19 is a thin lamina 13 made of non-magnetic material in order to guarantee a certain gap between the armature plate 17 and the core 19.

The valve body 7 comprises a control chamber 26 for controlling metering of the fuel to be injected, which includes a volume delimited radially by the lateral surface of the hole 9. Axially, the volume of the control chamber 26 is delimited by a terminal surface 25 of the rod 10 and by a bottom wall 27 of the hole 9 itself To receive the fuel under pressure, the control chamber 26 communicates permanently with the inlet 4 through a duct 32 made in the body 2 and an inlet duct 28 made in the valve body 7.

The duct 28 is provided with a calibrated stretch 29, which gives out into the control chamber 26 in the vicinity of the bottom wall 27. In order to reduce the control volume 26 as much as possible, advantageously the terminal surface 25 of the rod 10 is shaped like a truncated cone. On the outside of the valve body 7, the inlet duct 28 gives out into an annular chamber 30, into which also the duct 32 gives out.

The valve body 7 moreover comprises a flange 33 housed in a portion 34 of the cavity 6, having an enlarged diameter. The flange 33 is set axially in contact with an internal shoulder 35 of the cavity 6, in a fluid-tight way, by a threaded ring nut 36 screwed on an internal thread 37 of the portion 34 of the cavity 6.

As it will seen more clearly hereinafter, the armature plate 17 is associated to a bushing 41 axially guided by a guide element, formed by an axial stem 38, which is made of a single piece with the flange 33 of the valve body 7. The stem 38 has a diameter much smaller than that of the flange 33 and extends in cantilever fashion from the flange 33 itself along the axis 3 on the side opposite to the hole 9, i.e., towards the cavity 22.

The stem 38 is delimited externally by a cylindrical lateral surface 39, which guides the axial sliding of the bushing 41. In particular, the bushing 41 has a cylindrical internal surface 40, coupled to the lateral surface 39 of the stem 38 substantially in a fluid-tight way, i.e., by means of a coupling with appropriate diametral play, for example less than 4 μm, or else by interposition of specific seal elements.

The control chamber 26 also has a passage 42*a* for outlet of the fuel, having a restriction or calibrated stretch 53, which has in general a diameter comprised between 150 and 300 μm. The outlet passage 42*a* is in communication with an exhaust duct 42, made inside the flange 33 and the stem 38. The duct 42 comprises an axial blind stretch 43, made along the axis 3, in part in the flange 33 and in part in the stem 38. The axial stretch 43 has a diameter greater than that of the calibrated stretch 53.

The duct 42 also comprises at least one substantially radial stretch 44, in communication with the axial stretch 43. Advantageously, there can be provided two or more radial stretches 44, set at constant angular distances apart. Shown in FIG. 1 are two radial stretches 44, which are advantageously inclined with respect to the axis 3 towards the armature plate 17. The radial stretches 44 give out into an annular chamber 46, formed by a groove of the lateral surface 39 of the stem 38.

The annular chamber 46 is made in an axial position adjacent to the flange 33 and is opened/closed by a terminal portion of the bushing 41, which forms an open/close element 47 for said annular chamber 46 and hence also for the radial stretches 44 of the duct 42. The open/close element 47 terminates with a stretch having an internal surface shaped like a truncated cone 45 (FIG. 2) flared downwards and designed to engage a truncated cone joining stretch 49 set between the flange 33 and the stem 38.

In particular, the truncated cone stretch 49 has two portions of truncated cone surface 49*a* and 49*b*, separated by an annular groove 50, which has a cross section substantially shaped like a right triangle. The truncated cone surface 45 of the open/close element 47 engages in a fluid-tight way the portion of truncated cone surface 49*a*, against which it stops in a closed position. On account of the wear between these surfaces 45 and 49*a*, the closed position of the open/close element 47 requires, after a certain time of use of the servovalve 5, a greater displacement of the bushing 41 towards the joining stretch 49.

The groove 50 has the function of enabling said greater displacement for closing of the open/close element 47, always defining a maximum diameter of the sealing surface equal to the diameter of the cylindrical stretch of the annular groove 50. Consequently, the groove 50 guarantees that the forces of unbalancing, due to the pressure acting on the surface 45 of the bushing 41, will always be contained within a certain value, in any case lower than the force exerted by the spring 23.

The armature plate 17, which is made of a magnetic material, is constituted by a distinct piece, i.e., separate from the bushing 41. It has a central portion 56 having a plane bottom surface 57, and a notched annular portion 58 that has a cross section tapered toward the outside. The central portion 56 has an axial hole 59 through which the armature plate 17 is able to slide with a certain radial play along an axial portion of the bushing 41. Said axial portion is adjacent to a projection designed to be engaged by the surface 57 of the portion 56 of the armature plate 17.

Figure 2:
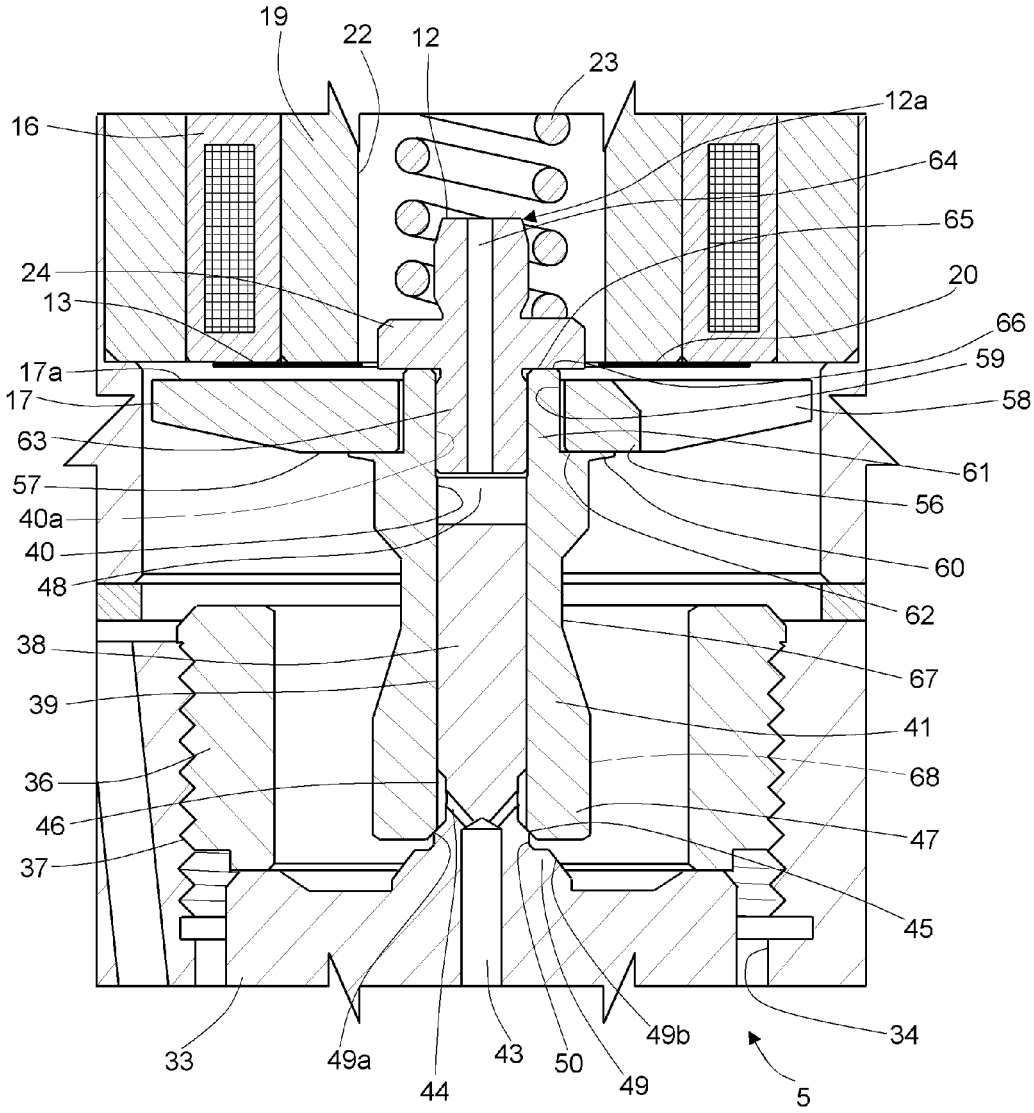
FIG. 2 is a detail of FIG. 1 at an enlarged scale.
Figure 3:
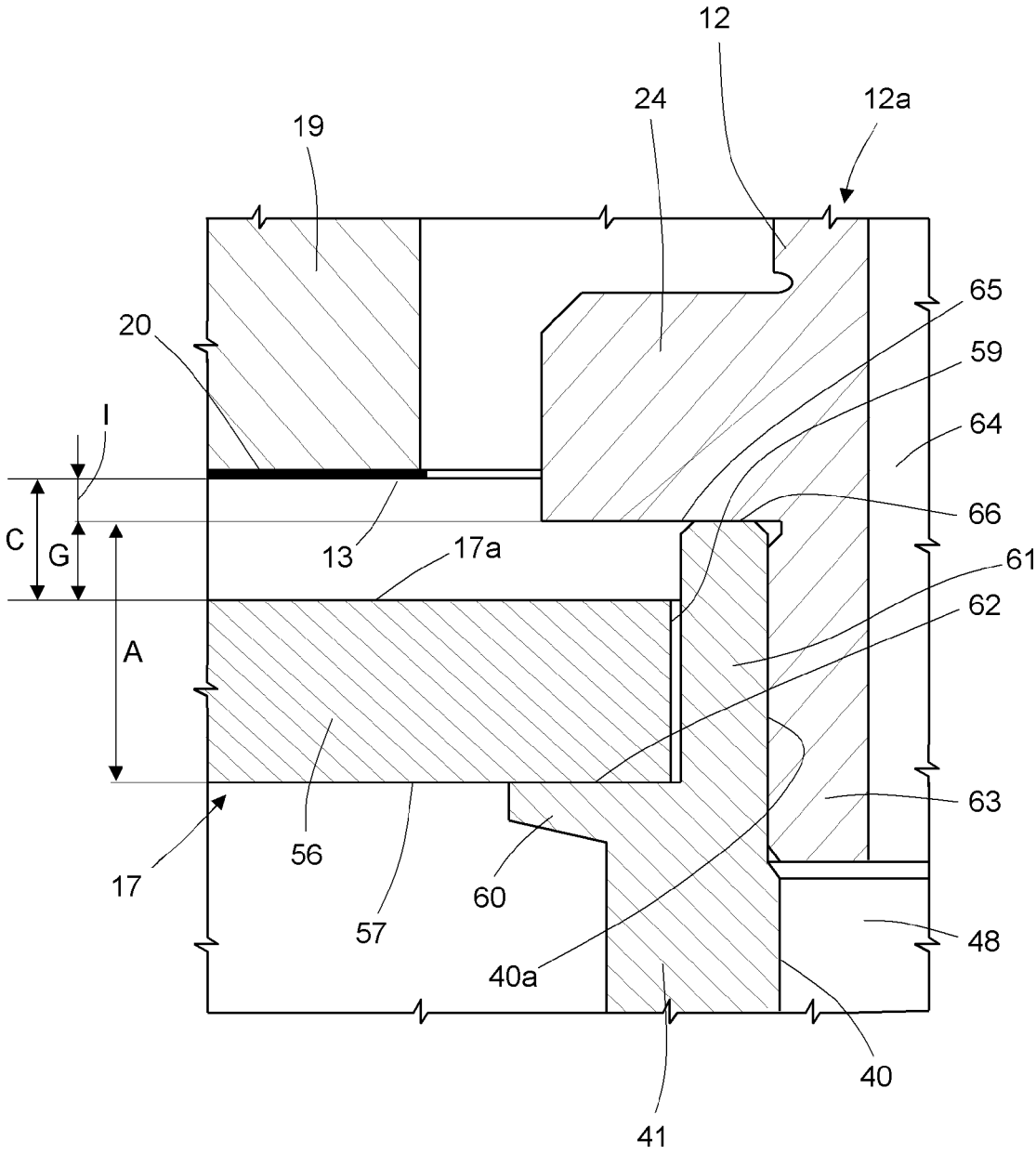
FIG. 3 is a portion of FIG. 2 at a further enlarged scale.

In the embodiment of FIGS. 1-3, said axial portion is formed by a collar 61 that extends from a flange 60 of the bushing 41. The collar 61 has a smaller diameter than the bushing 41, and therefore than the flange 60. The projection of the bushing 41 is constituted by a shoulder 62 formed between the collar 61 and the flange 60. The shoulder 62 is set in such a way as to create with the engagement means 24 an axial play G (FIG. 3) of a predetermined amount for the armature plate 17, to enable a relative axial displacement between the armature plate 17 and the bushing 41. In particular, the axial play G is created between the shoulder 62 and a surface 65 of the flange 24 designed to engage the surface 17*a* of the armature plate 17.

Furthermore, the intermediate body 12*a* comprises an element for connection with the bushing 41, which is formed by another connection pin 63 made of a single piece with the flange 24. In the embodiment of FIGS. 1-3, the pin 63 is rigidly fixed to the bushing 41, in a corresponding seat 40*a* (FIG. 2), by means of a threaded coupling, gluing, welding, or force fit. In the embodiment of FIGS. 1-3, the seat 40*a* is formed by a top portion of the internal surface 40 of the bushing 41, and the pin 63 is force fitted in said seat 40*a*.

Advantageously, the seat 40*a* has a diameter slightly greater than that of the internal surface 40 of the bushing 41 that couples with the surface of the pin 39. In this way, the surface 40, which requires a more accurate grinding, i.e., the surface that is to form a dynamic seal with the surface 39 of the stem 38, has a smaller axial length, with evident economic advantages.

The connection pin 63 is coaxial with the guide pin 12 for the spring 23, and extends axially from a bottom surface 65 of the flange 24, in a direction opposite to that of said guide pin 12. Between the surface 39 of the stem 38 and the surface 40 of the bushing 41, there is in general a certain leakage of fuel, which gives out into a compartment 48 between the end of the stem 39 and the connection pin 63. To enable exhaust of the fuel that has leaked into the compartment 48 towards the cavity 22, advantageously the intermediate body 12*a* is provided with an axial hole 64.

For proper assembly of the intermediate body 12*a*, it is expedient for the surface 65 of the flange 24 to bear upon an end surface 66 of the collar 61 of the bushing 41. In fact, in this way, there is uniquely defined the distance, or space between the surface 65 of the flange 24 and the shoulder 62 of the bushing 41 that constitutes the housing A of the armature plate 17 (see also FIG. 3). The bushing 41 has an outer surface 68, in which an intermediate portion 67 between the shoulder 62 and the open/close element 47 has a reduced diameter in order to reduce the inertia of the bushing 41.

Assuming that the lamina 13 is fixed with respect to the polar surface 20 of the core 19, when the bushing 41 is held by the spring 23 through the intermediate body 12*a*, in a closed position of the servovalve 5, the distance of the plane surface 17*a* from the lamina 13 defines the travel or lift C of the armature plate 17. The armature plate 17 is hence resting against the shoulder 62, in the position indicated in FIGS. 1-3, as will emerge more clearly from what follows. In actual fact, since the lamina 13 is non-magnetic, it could occupy axial positions different from the one assumed, but this does not change the definition assumed for the lift C of the armature plate 17. It is essential for the lift C of the armature plate 17 to be greater than the play G of said armature plate 17 in its housing A.

The travel, or lift I of opening of the open/close element 47 is equal to the difference between the lift C of the armature plate 17 and the play G. Consequently, once again assuming that the lamina 13 is fixed with respect to the polar surface 20, the surface 65 of the flange 24 normally projects from the lamina 13 downwards by a distance equal to the lift I of the open/close element 47, along which the armature plate 17 draws the flange 24 upwards. The armature plate 17 can therefore perform, along the collar 61, an overtravel equal to said play G, which occurs along the housing A, in which the axial hole 59 of the armature plate 17 is guided axially by the collar 61.

Preferably, the lift I of the open/close element 47, and hence of the bushing 41, can be comprised between 12 and 30 μm. According to the embodiment of FIGS. 1-3, preferably the play G can be comprised between 6 and 30 μm, so that the travel C will be comprised between 18 and 60 μm. Consequently, the ratio C/I between the lift C of the armature plate 17 and the lift I of the open/close element can be comprised between 0.6 and 5, whilst the ratio I/G between the lift I and the play G can be comprised between 0.4 and 5.

Operation of the servovalve 5 of FIGS. 1-3 is described in what follows.

When the electromagnet 16 is not excited, the open/close element 47 is kept, by the spring 23 through the body 12*a* rigidly connected to the bushing 41, resting with its truncated cone surface 45 against the truncated cone surface surface 49*a* of the joining stretch 49, so that the servovalve 5 is closed. It is assumed that, on account of the force of gravity and/or of the previous closing step, which will be seen hereinafter, the armature plate 17 comes to be detached from the lamina 13 and resting against the shoulder 62. This hypothesis does not affect the effectiveness of operation of the servovalve 5, which is irrespective of the axial position of the armature plate 17 at the instant of opening of the servovalve 5 itself Hence in the annular chamber 46 there has been set up a pressure of the fuel, the value of which is equal to the pressure of supply of the injector 1. When the electromagnet 16 is excited to carry out a step of opening of the servovalve 5, the core 19 attracts the armature plate 17, which at the start effects an idle travel, equal to the play G illustrated in FIG. 3, until it is brought into contact with the surface 65 of the flange 24, substantially without affecting the displacement of the bushing 41. Next, the action of the electromagnet 16 on the armature plate 17 overcomes the force of the spring 23 and, via the flange 24 and the fixing pin 63, draws the bushing 41 towards the core 19 so that the open/close element 47 opens the servovalve 5.

Consequently in this step, the armature plate 17 and the bushing 41 move in a rigid way and thus traverse the stretch I by the entire travel C allowed for the armature plate 17. On account of the type of stresses to which the armature plate 17 is subjected and on account of the width of the surfaces that are in contact, i.e., the polar surface 20, lamina 13, and surface 17*a*, the impact of the armature plate 17 against the lamina 13/core 19 ensemble occurs with a practically negligible rebound.

When excitation of the electromagnet 16 ceases, the spring 23, via the body 12*a*, causes the bushing 41 to accomplish a travel of closing of the servovalve 5 towards the position of FIGS. 1-3. During a first stretch of this travel of closing, the flange 24, the surface 65 of which is in contact with the surface 66 of the bushing 41, draws the armature plate 17 for the distance I, which thus moves together with the bushing 41 and hence with the open/close element 47.

After travelling this stretch I, the open/close element 47 collides with its conical surface 45 against the conical surface 49*a* of the joining stretch 49 of the valve body 7. On account of the small area of contact and of the hardness of the open/close element 47 and of the valve body 7, and also because the contact occurs in the presence of a considerable amount of vapour of the fuel, the open/close element 47 rebounds, overcoming the action of the spring 23, while the armature plate 17 continues its travel towards the valve body 7, recovering the play G existing in the housing A between the plane surface 57 of the portion 56 and the shoulder 62 of the flange 60.

It is evident that, at the instant in which rebound of the open/close element 47 occurs, this reverses its direction of motion and starts to move towards the armature plate 17. After a certain time, there then occurs a collision of the plane surface 57 of the portion 56 against the shoulder 62 of the bushing 41. As a result of this collision, and also on account the greater momentum of the armature plate 17, at the instant of this collision, the amount of the first rebound of the bushing 41 is sensibly reduced or even cancelled out, thus preventing the control chamber 26 from emptying suddenly. In this way, any alteration of the gradient of variation envisaged for the pressure in the control chamber 26 is eliminated and hence any delay of closing of the needle of the nebulizer.

In actual fact, after the first rebound thus reduced, there can be generated a train of rebounds of decreasing amplitude, the amount of which is much smaller than that of the first rebound already reduced so that not even these rebounds manage to determine a decrease in pressure in the control chamber 26. Consequently, there is no anomalous reconstitution in re-establishing the pressure of the fuel in the control chamber 26, and hence in the motion of the rod 10, which can close the nebulizer without any discontinuity in its motion of closing. The armature plate 17 finally remains in contact with the shoulder 62, also by the force of gravity.

Figure 4:
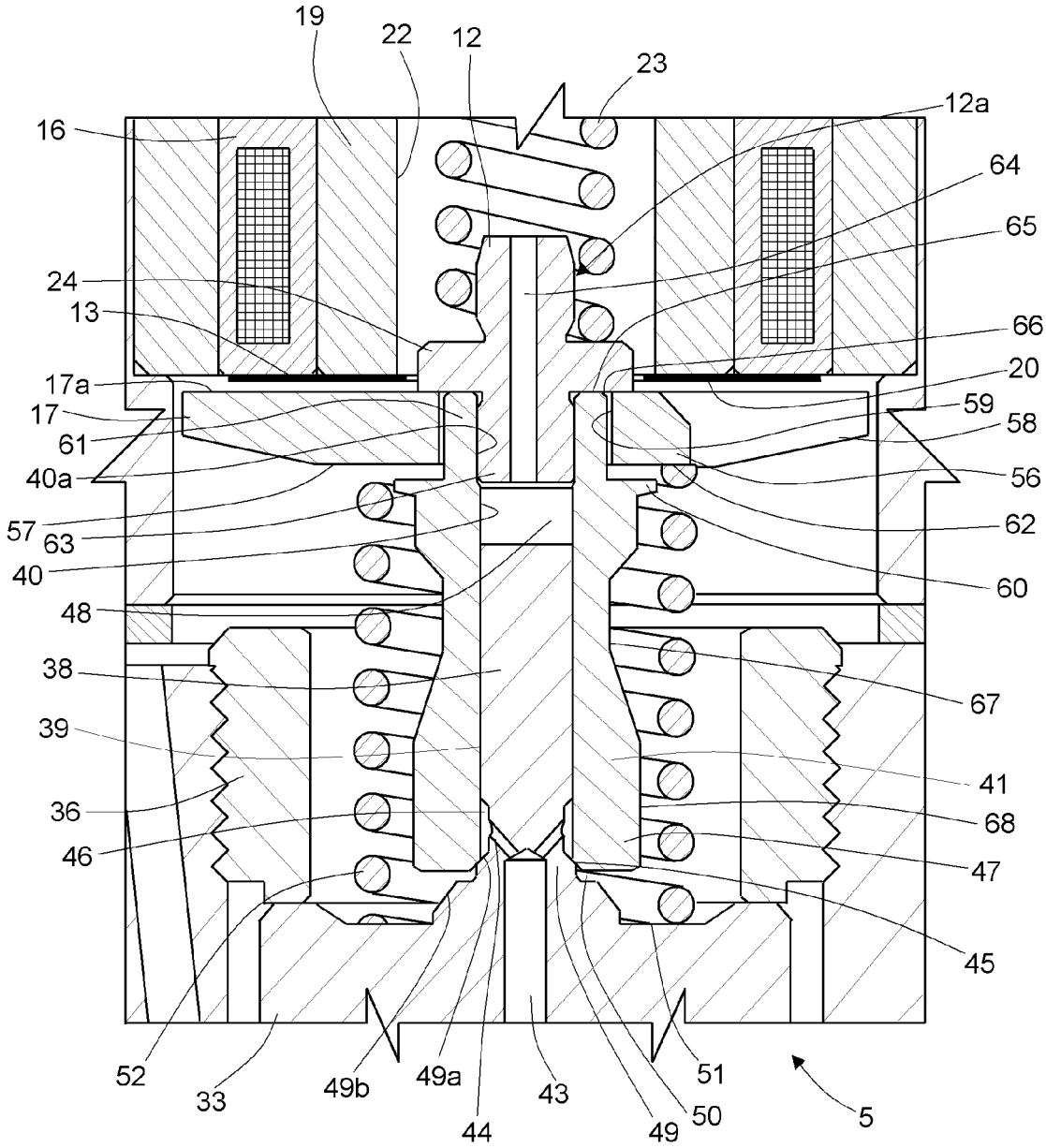
FIG. 4 is a vertical cross section of the detail of FIG. 2 according to another embodiment of the invention.
Figure 5:
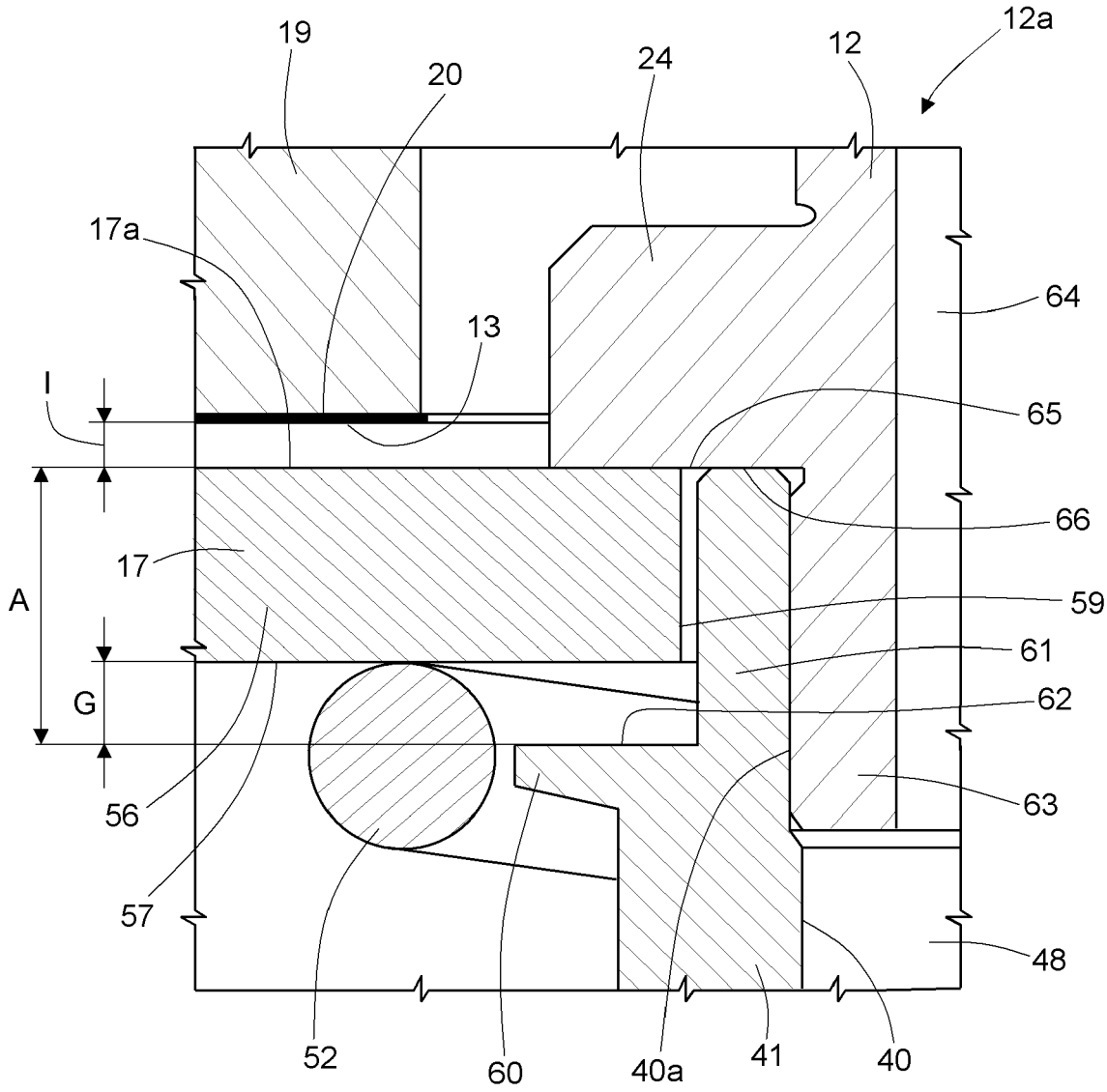
FIG. 5 is a portion of FIG. 4 at a further enlarged scale.

In the embodiments of FIGS. 4-5 and 6-7, the parts that are the same as the analogous parts of the embodiment of FIGS. 1-3 are designated by the same reference numbers, and will not be described any further. According to the embodiment of FIGS. 4 and 5, in order to reduce the times of opening of the open/close element 47, especially when the injector 1 is supplied at low pressure, between the surface 57 of the portion 56 of the armature plate 17 and a depression 51 of the top surface of the flange 33 of the valve body 7, a helical compression spring 52 is inserted. The spring 52 is pre-loaded so as to exert a force that is much lower than that exerted by the spring 23, but sufficient to keep the armature plate 17, with the surface 17*a* in contact with the surface 65 of the flange 24, as illustrated in FIGS. 4 and 5. In this embodiment, the idle travel of the armature plate 17 (i.e., the play G) can be chosen between 10 and 30 μm so that the travel C is between 22 and 60 μm, the ratio C/I is between 0.7 and 5, and the ratio I/G is between 0.41 and 5.

In the embodiment of FIGS. 4 and 5, upon excitation of the electromagnet 16, the armature plate 17 on the one hand performs a smaller travel towards the core 19, on the other hand it immediately draws along the bushing 41. There is thus obtained a faster opening of the open/close element 47, i.e., a faster response of the open/close element 47 to the corresponding command, but the damping of the rebound in the travel of closing of the open/close element is similar to that of the embodiment of FIGS. 1-3.

Figure 6:
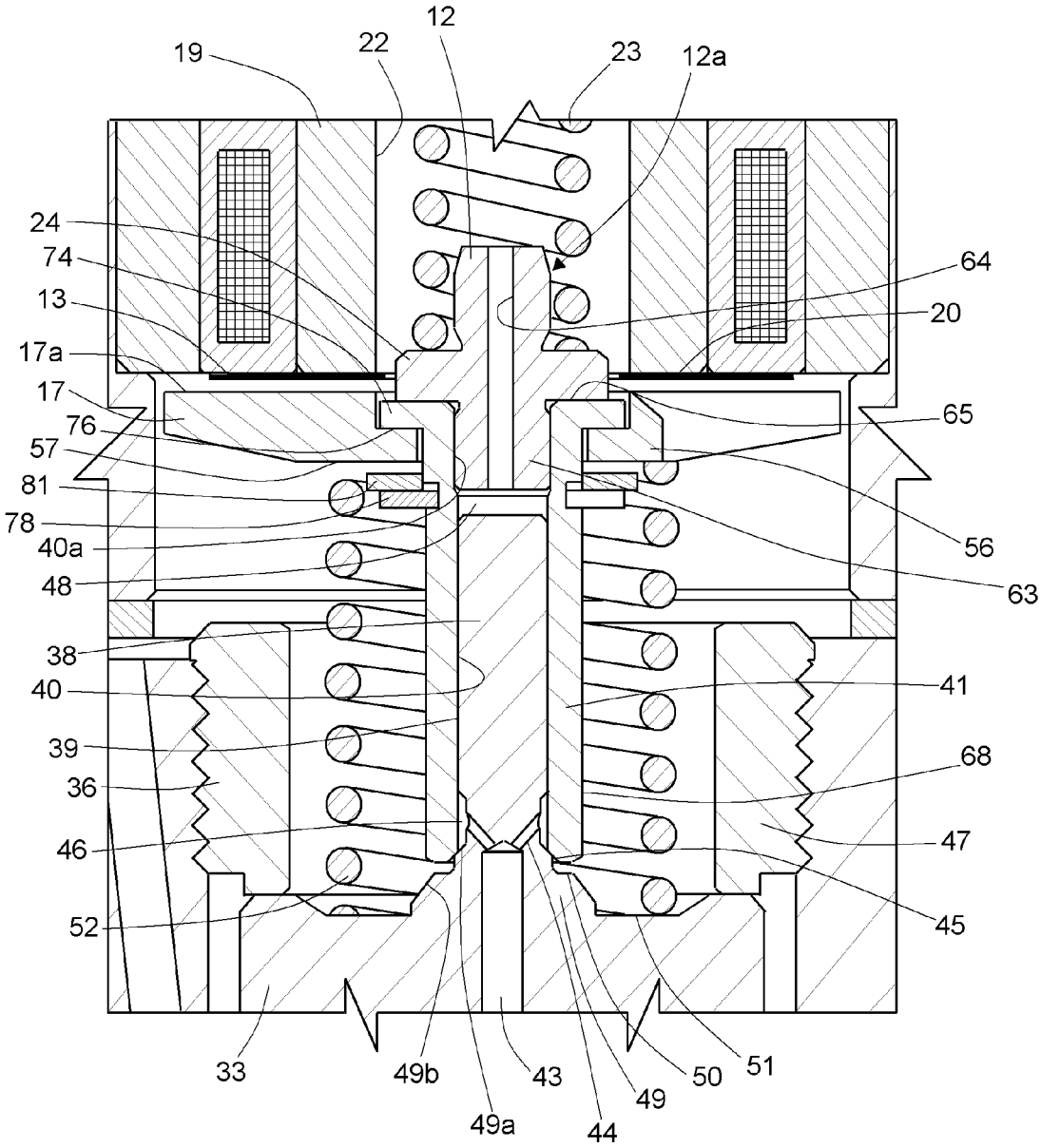
FIG. 6 is a vertical cross section of the detail of FIG. 2 according to a further embodiment of the invention.
Figure 7:
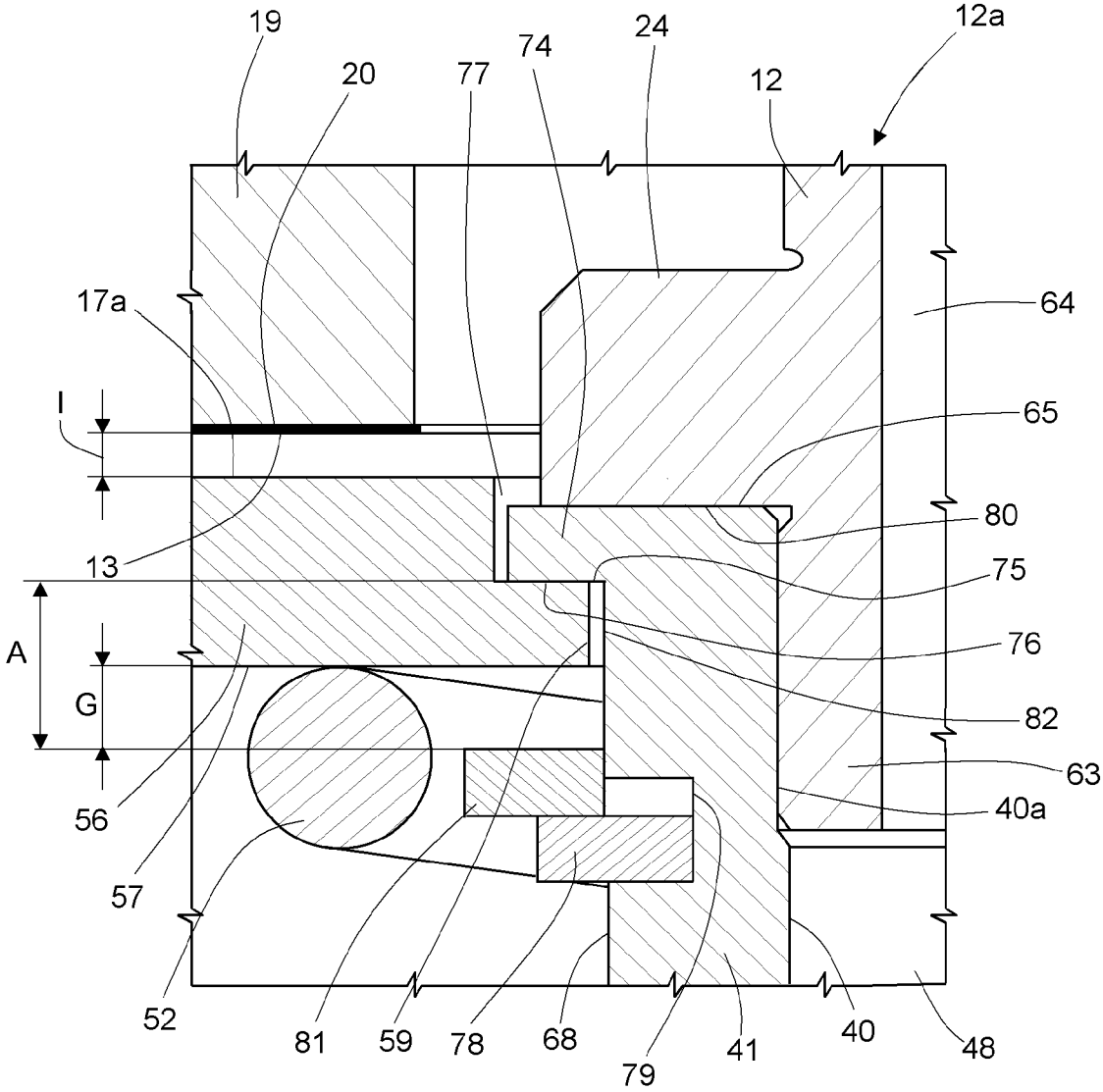
FIG. 7 is a portion of FIG. 6 at a further enlarged scale.

In the embodiment of FIGS. 6 and 7, the engagement means between the bushing 41 and the armature plate 17 are represented by a rim or annular flange 74 made of a single piece with the bushing 41. In particular, the annular flange 74 is provided with a plane surface 75 designed to engage a shoulder 76 formed by an annular depression 77 of the plane surface 17*a* made in the central portion 56 of the armature plate 17.

Furthermore, the external diameter of the portion of the bushing underlying said annular flange 74 is smaller than the internal diameter of said annular flange 74. Consequently, during assembly, the armature plate 17 is inserted on the side of the open/close element 47 of the bushing 41. The central portion 56 of the armature plate 27 is able to slide on an axial portion 82 of the bushing 41 adjacent to the rim 74. In addition, the rim 74 is adjacent to an end surface 80 of the bushing 41, which is in contact with the surface 65 of the flange 24. The shoulder 76 of the armature plate 17 is normally kept in contact with the plane surface 75 of the rim 74 by the compression spring 52 in a way similar to the embodiment of FIGS. 4 and 5.

In the embodiment of FIGS. 6 and 7, the projection means carried by the bushing 41, for engaging the plane surface 57 of the portion 56 of the armature plate 17, comprise a C-shaped retention ring 78. The C-shaped retention ring 78 is removably housed in a groove 79 of the outer surface 68 of the bushing 41.

Housing A is defined as the distance between the plane surface 75 and the surface of the projection means 78, 81 that is in contact with the surface 57 of the armature plate 17. The thickness S of the radial portion 56 that slides along the axial portion 82 of the bushing 41 is defined by the relation S ≥A−G. Furthermore, the travel C of the armature plate 17 is C=I+G, as has been seen for the embodiment of FIGS. 1-3.

In this embodiment, the intermediate body 12*a* is connected to the bushing 41 by means of a unidirectional axial constraint. In particular, the flange 24 of the intermediate body 12*a* engages, with its surface 65, an end edge 80 of the bushing 41, but the connection pin 63 carried by the flange 24 is simply inserted in the axial seat 40*a*. Consequently, the pin 63 can have a certain radial play with respect to the seat 40*a*, and the intermediate body 12*a* can undergo an axial displacement with respect to the bushing 41 itself.

The retention ring 78 can have a modular thickness to enable an adjustment of the travel C of the armature plate 17. The retention ring 78 can be used as support for at least one spacer 81 having a modular thickness to enable an adjustment of the travel C of the armature plate 17 in addition to or instead of that of the ring 78. Also in this case, the play G can be between 10 and 30 μm, as in the embodiment of FIGS. 4 and 5.

In all the embodiments described above, the bushing 41 may be machined with extreme precision, for example, with a tolerance in the region of 1 μm, both to enable the fluid tightness of the fuel under pressure along the side wall 39 of the stem 38 and to enable the fluid tightness of the fuel of the annular chamber 46 by means of the truncated cone surface 45. For said purpose, the bushing 41 is made of very hard material, such as a steel for tooling. The internal surface 40 of the bushing 41 is grinded accurately, and the bushing 41 can possibly be subjected to one or more thermal treatments that will bestow thereon a greater resistance to wear and fatigue, such as hardening and/or nitridation.

For technological reasons, in one or more embodiments, the calibrated stretch 53 (FIG. 1) of the outlet duct 42*a* can be pre-arranged in an element separate from the valve body 7. In the embodiments described herein, the separate element is formed by a bushing 54 made of very hard material, which includes the outlet passage 42*a* and the calibrated stretch 53. The bushing 54 is subsequently fixed in a seat 55 of the hole 9. The bottom wall 27 of the control chamber 26 is defined by the transverse surface of the bushing 54. The calibrated stretch 53 can be obtained with great precision, and is limited only to a part of the axial length of the bushing 54, while along the rest of the length of the bushing 54 the outlet passage 42*a* can have a diameter smaller than or equal to that of the axial stretch 43.

Figure 8:
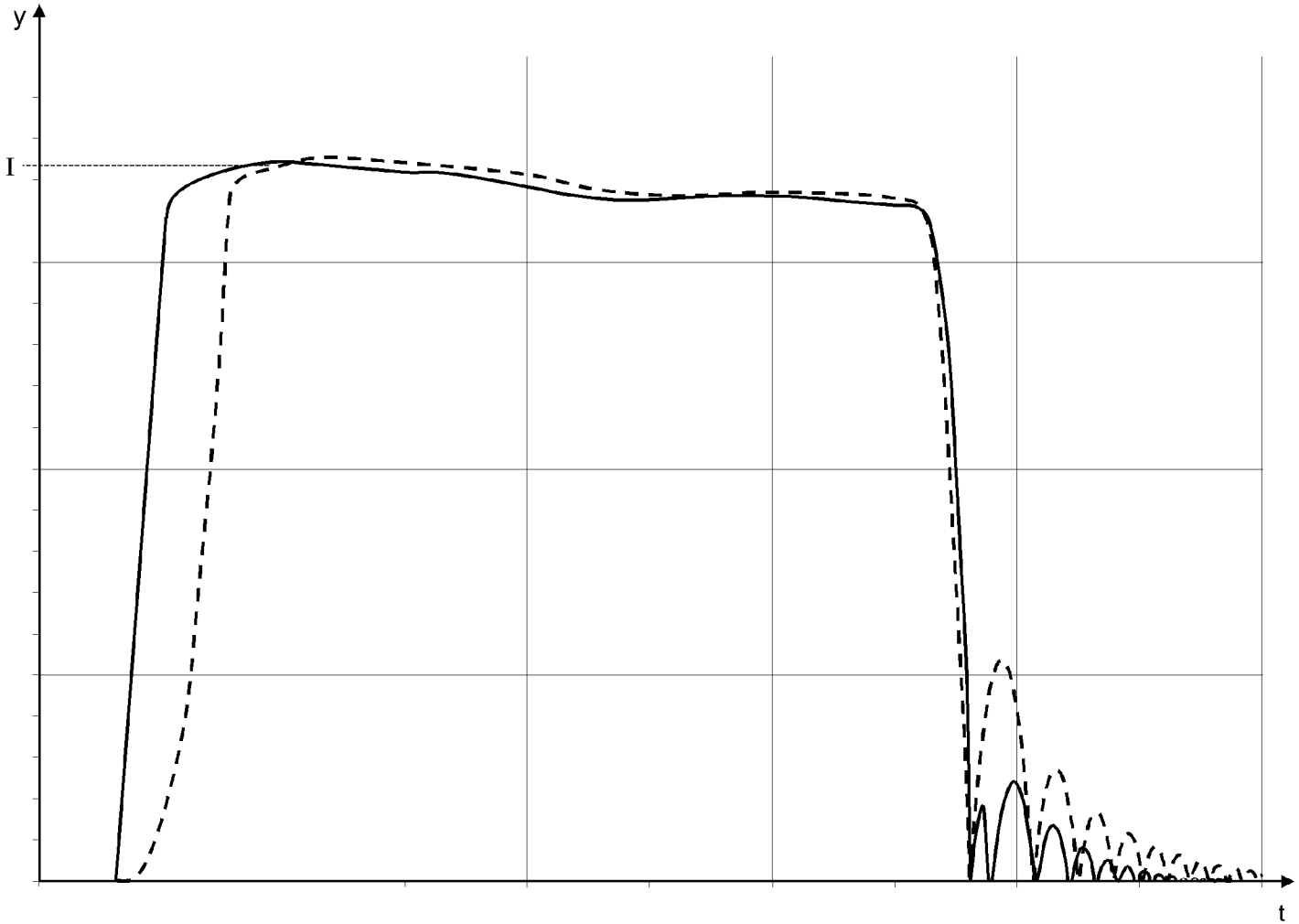
FIGS. 8-10 are comparative plots of operation of the injectors according to one or more embodiments of the invention.
Figure 9:
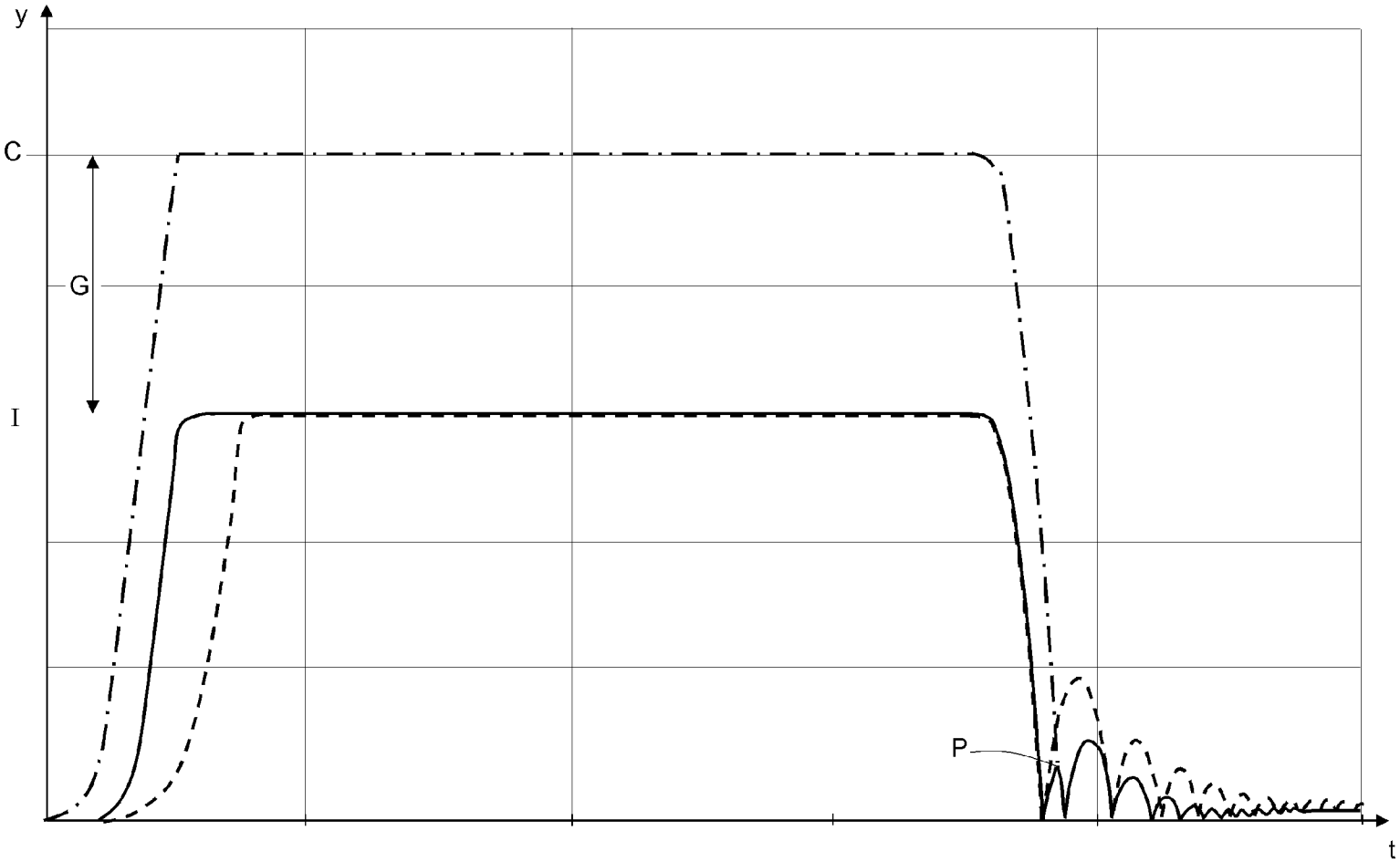
Figure 10:
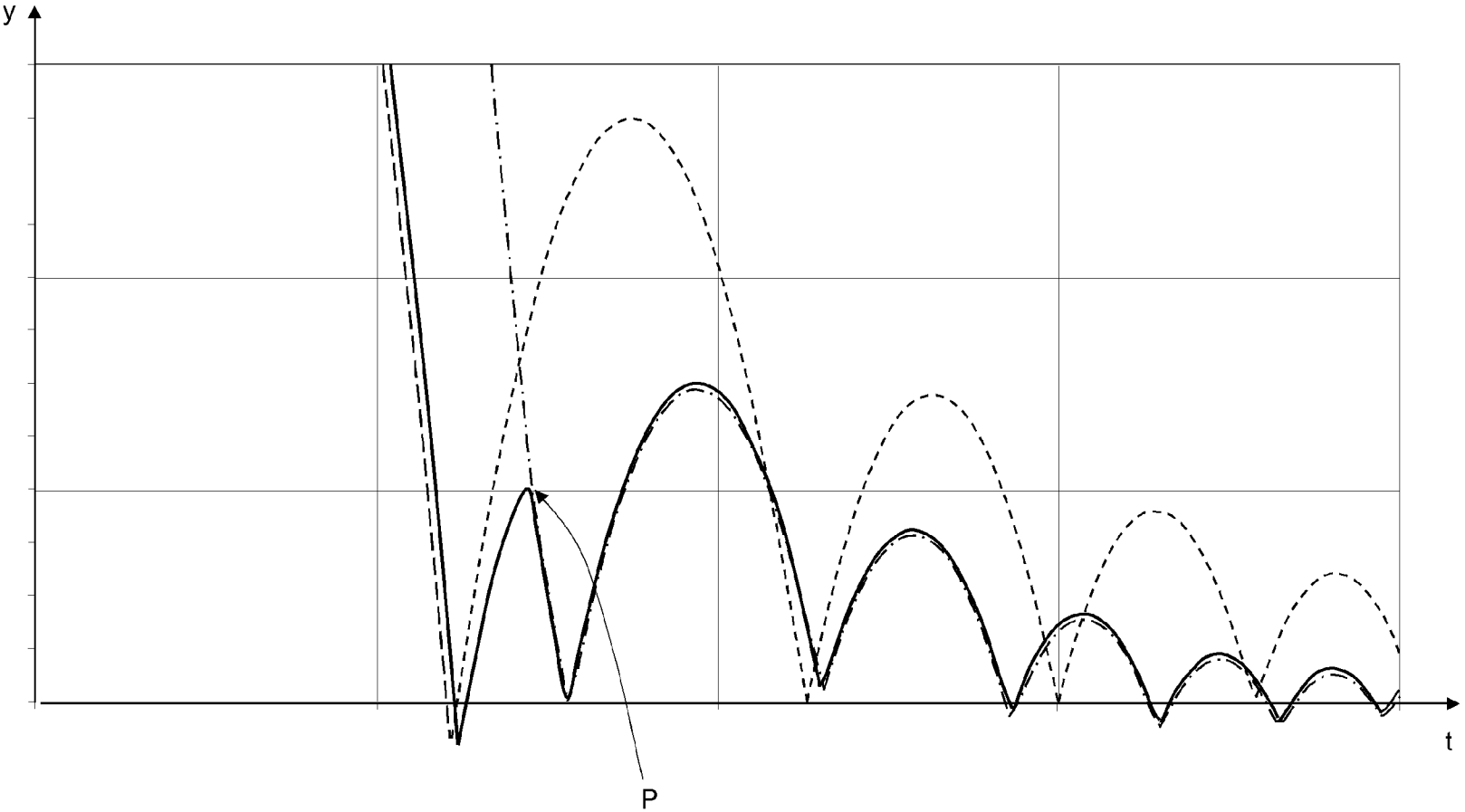

FIGS. 8-10 are plots of the operation of the injector 1, in comparison with the operation of an injector according to the known art. The plots of the injector 1 are described with regard to the embodiment illustrated in FIGS. 1-3, but are well suited to describing, qualitatively, the principle of operation of other embodiments of the invention. In FIG. 8, represented by the solid line, as a function of time t, is the displacement, with respect to the valve body 7, of the open/close element 47 separate from the armature plate 17 (see FIGS. 3, 5 and 7).

Both the armature plate 17 and the bushing 41 have been each made with a weight in the region of 2 g. The value "I", indicated on the axis Y of the ordinates, represents the maximum travel I allowed for the open/close element 47. Represented by a dashed line is, instead, the lift of an open/close element according to the known art, in which the armature plate is made of a single piece with the bushing, the total weight of which is in the region of 4 g. The two plots are obtained by visualizing the effective displacement of the open/close element 47. From the two plots it is clear that the motion of opening of the open/close element 47 according to one or more embodiments of the invention occurs with a more prompt response with respect to the motion of opening of the open/close element according to the known art. This is due both to the fact that the armature plate 17 is made of a material with better characteristics of magnetization and to the fact that the armature plate 17 is separate from the bushing 41.

At the end of the motion of closing, the open/close element according to the known art makes a series of rebounds of decreasing amplitude, of which the amplitude of the first rebound is decidedly considerable. Instead, for the open/close element 47 according to one or more embodiments of the invention, having assumed for the ratio C/I a value between 0.7 and 5 and for the ratio I/G a value between 0.4 and 5, the amplitude of the first rebound is reduced to approximately 30% with respect to the one of the known art. Also the subsequent rebounds are damped more quickly.

In FIG. 9, presented with a larger scale on the axis Y of the ordinates are the two plots of FIG. 8, slightly simplified, so that the lift of the two open/close elements is indicated as constant during the entire period of opening. On the axis of the ordinates, the value "C" given is equal to the maximum travel allowed for the armature plate 17. In FIG. 9, there is moreover indicated, with a dashed-and-dotted line, the displacement of the armature plate 17, which performs, in addition to the lift I of the open/close element 47, an overtravel equal to the play G between the armature plate 17 and the flange 24.

Towards the end of the travel of closing of the armature plate 17, the latter at the instant designated by the point P hits against the projection means 62 of the bushing 41, which makes the first rebound. The bushing 41 is then pushed by the armature plate 17 towards the closed position. From the instant of this impact onwards, the armature plate 17 remains in contact with the retention means 62, oscillating imperceptibly together with the bushing 41.

Presented at a very enlarged scale in FIG. 10 are the plots of FIG. 9, substantially starting from the stretch in which the first rebound occurs. It is consequently evident that, after collision of the armature plate 17 against the shoulder 62 in the embodiment of FIGS. 1-3, the bushing 41 oscillates practically together with said armature plate 17.

In general, given the same travel I of the open/close element 47, the greater the play G between armature plate 17 and the flange 24, the greater the delay of its travel with respect to that of the bushing 41, so that the dashed-and-dotted line of FIG. 10 shifts towards the right. The amount of the first rebound of the open/close element 47 is hence greater given that the impact during re-opening between the open/close element 47 that rebounds and the armature plate 17 that proceeds its travel occurs with a delay corresponding to said play. However, since the armature plate 17 has acquired greater speed, due to the greater momentum, the impact cancels out the kinetic energy of the bushing 41 during rebound, which can now return with lower speed towards the closed position, without further rebounds, or with a few rebounds of the open/close element 47 of negligible amplitude.

Instead, with a smaller play between the armature plate 17 and the flange 24, at the first rebound at the end of the travel of closing of the open/close element 47 the retention means 62 or 78, 81 immediately encounter the armature plate 17. This is then drawn along, reversing its movement and exerting a reaction against the spring 23. In this case, the train of rebounds subsequent to the first could be temporally longer.

From what has been seen above, the advantages of the injector 1 according to one or more embodiments of the invention as compared to the injectors of the known art are evident. In the first place, the armature plate 17 is separate from the guide bushing 41 and displaceable independently of the latter to enable reduction or elimination of the rebounds of the open/close element 47 especially at the end of the travel of closing. In this way, there is prevented injection of a volume of fuel greater than the one envisaged, alteration of the air/fuel ratio, and reduction of environmental pollution by the engine exhaust gases.

Furthermore, since the armature plate 17 is separate from the guide bushing 41 the material for the armature plate 17 may be chosen so as to optimize the electromagnetic circuit and enable choosing a material with high resistance to wear for the bushing 41. In this way, there is prevented the drawback of also machining the armature plate 17 from said material, with considerable swarf of said material. The construction of the armature plate 17 from a softer material is thus considerably simplified. Finally, the mass of the moving element that the electromagnet 16 and the spring 23 must displace is reduced.

It is evident that further modifications and improvements can be made to the injector 1, without thereby departing from the scope of the embodiments of the invention. For example, in the embodiments of FIGS. 1-5, the flange 60 of the bushing 41 can be eliminated. Furthermore, the intermediate body 12*a* can be fixed to the bushing 41 in an adjustable way, for example, with connection by means of a thread, in order to adjust the play G between the armature plate 17 and the flange 24.

To adjust the play G between the armature plate 17 in the housing A made between the surface 65 and the shoulder 62 of the bushing 41, there can be inserted at least one disk-shaped spacer having an appropriate modular thickness, for example in 5-μm steps, coaxial with the same armature plate 17. Said spacers contribute also to further damping of the collisions between the armature plate 17 and the bushing 41, with a further beneficial effect as regards elimination of the rebounds.

In the embodiment of FIGS. 6 and 7, the retention ring 78 can also be welded on the bushing 41, instead of being mounted in a removable way. Furthermore, in this embodiment, the spring 52 can be eliminated so that the armature plate 17 behaves as in the case of the embodiment of FIGS. 1-3.

In turn, the lamina 13 can have an internal diameter smaller than the external diameter of the flange 24, and even the same as the internal diameter of the armature plate 17. In this case, the lamina 13 remains constrained in the housing A and consequently cannot undergo radial displacements. It is evident that in this case the axial length of the housing A must be increased by the thickness of the lamina 13 itself In turn, the joining 49 between the stem 38 and the flange 33 of the valve body 7 can be without the groove 50, and the surface shaped like a truncated cone 45 of the open/close element 47 can be replaced by a sharp edge. The support 54 of the calibrated hole 53 can be eliminated, or else assumes a different shape from the one illustrated. Furthermore, the radial stretches 44 of the duct 42 can number more than two and be set at the same angular distance apart from one another and/or be perpendicular to the axis 3. The calibrated stretch 53 can also be set on the radial stretches 44 of the duct 42. The valve body 7 can be divided into two parts, one part containing the stem 38 and a portion of the flange 33, the other part containing the remaining portion of the flange 33 and the hole 9. Finally, the electromagnet 16 can be replaced by a piezoelectric actuation device.

The invention claimed is:

1. A fuel injector, comprising:

a balanced metering servovalve for an internal-combustion engine, wherein the servovalve controls a control rod for controlling injection, which is mobile along an axial cavity, said servovalve having:

a valve body comprising a control chamber provided with a calibrated inlet for the fuel, and an outlet passage in communication with an exhaust duct carried by an axial stem;

an open/close element carried by a bushing being mobile along said stem and being controlled by an armature plate controlled by an electro-actuator, said exhaust duct comprising at least one substantially radial stretch that gives out onto a lateral surface of said stem; said bushing being normally coupled in a fluid-tight way with said stem so as to slide axially between a position of closing and a position of opening of said stretch; said bushing being kept in said closed position by elastic means; and wherein said armature plate is separate from said bushing and in that said elastic means act upon said bushing through an intermediate body for bringing said open/close element into said closed position, engagement means being provided for bringing said open/close element into said open position by said armature plate upon actuation of said electro-actuator, said armature plate comprising a plane surface designed to engage axially projection means carried by said bushing, a predetermined axial play being envisaged between said armature plate and said engagement means or said projection means to enable a relative axial displacement between said armature plate and said bushing.

2. The injector according to claim 1, wherein said armature plate is provided with a central portion guided axially by a corresponding axial portion of said bushing.

3. The injector according to claim 2, wherein said armature plate is axially mobile in an axial housing formed between said projection means and said engagement means, the difference between said axial housing and the axial thickness of said central portion forming said axial play.

4. The injector according to claim 3, wherein said bushing comprises an end surface that is in contact with said plane surface of said flange so as to define said axial housing.

5. The injector according to claim 3, wherein said armature plate is axially mobile in said axial housing for an axial travel, said open/close element being mobile between said open position and said closed position for a lift smaller than said travel.

6. The injector according to claim 5, wherein said axial travel is between 18 and 60 μm, the difference between said axial travel and said play being equal to said lift.

7. The injector according to claim 6, wherein the ratio between said axial travel and said lift is between 0.6 and 5, the ratio between said lift and said play being comprised between 0.4 and 5.

8. The injector according to claim 2, wherein inserted between said surface of said armature plate and said valve body is an elastic element, prevailing on which is the action of said elastic means, said elastic element being pre-loaded so as to keep said armature plate in contact with said engagement means.

9. The injector according to claim 8, wherein said bushing has an intermediate portion of reduced diameter set between said terminal portion and said projection means to reduce the inertia of said bushing.

10. The injector according to claim 2, wherein said elastic means comprises a helical compression spring having one end in engagement with said flange, a guide pin for said end extending from said flange axially along said helical spring, said injector being characterized in that said connection pin is coaxial with said flange and with said guide pin and extends axially in a direction opposite to said guide pin.

11. The injector according to claim 10, further comprising an annular lumina made of non-magnetic material set between said armature plate and said electro-actuator, said lamina having an internal diameter greater or smaller than the external diameter of said flange.

12. The injector according to claim 10, wherein said intermediate body is provided with a hole designed to set in communication a compartment between said bushing and said intermediate body with a cavity for exhaust of the fuel from said control chamber.

13. The injector according to claim 10, wherein said stem is carried by a flange of said valve body, said open/close element being formed by a terminal portion of said bushing and having a terminal stretch with an internal surface shaped like a truncated cone, designed to engage a stretch shaped like a truncated cone for joining between said flange and said stem.

14. The injector according to claim 13, wherein said radial stretch gives out into an annular chamber formed by an annular groove of said stem, said injector being characterized in that said joining comprises two surfaces shaped like a truncated cone separated by an annular groove to enable closing of said open/close element also following upon wear of said surfaces.

15. The injector according to claim 1, wherein said engagement means are formed by a flange of said intermediate body, said bushing being rigidly connected to said intermediate body.

16. The injector according to claim 15, wherein said projection means comprise an annular shoulder formed by a collar of said bushing, said central portion of said armature plate being able to slide on said collar, said flange being provided with a plane surface designed to define said axial travel.

17. The injector according to claim 15, wherein said end surface is carried by said collar, at least one spacer disk set coaxial to said armature plate and having a modular of thickness being fitted on said collar in said housing for adjusting said travel.

18. The injector according to claim 15, wherein said intermediate body comprises a connection element carried by said flange and designed to be connected to said bushing, another surface of said armature plate opposite to said plane surface being designed to be engaged by said flange.

19. The injector according to claim 18, wherein said connection element is formed by a connection pin made of a single piece with said flange, which is rigidly fixed in an axial seat of said bushing.

20. The injector according to claim 19, wherein said connection pin is fixed on said seat by means of a thread, said play being adjustable by variably screwing said connection pin.

21. The injector according to claim 1, wherein said engagement means are formed by an annular rim of said bushing, said intermediate body being connected to said bushing by means of a unidirectional axial constraint.

22. The injector according to claim 21, wherein said axial constraint comprises a flange of said intermediate body, said end surface being formed by an end surface of said bushing, said intermediate body comprising a connection pin carried by said flange and inserted in an axial seat of said bushing.

23. The injector according to claim 21, wherein said annular rim is adjacent to said end surface, said other surface of said armature body comprising an annular depression of a depth greater than the thickness of said annular rim.

24. The injector according to claim 23, wherein said bushing is provided with an annular groove adjacent to said axial portion and designed to house a ring enclosed in said projection for engagement of said armature body.

25. The injector according to claim 24, wherein said ring has a modular thickness to enable an adjustment of said travel.

26. The injector according to claim 24, wherein said ring is designed to support at least one spacer having a modular thickness to enable adjustment of said travel.

27. The injector according to claim 1, wherein said control chamber is defined by a bottom wall of said valve body, said outlet passage being carried by said bottom wall and being provided with a calibrated portion.

28. The injector according to claim 27, wherein said valve body is provided with a seat designed to receive a bushing having said outlet passage, said control chamber being defined by a transverse surface of said bushing.

29. The injector according to claim 1, wherein said armature plate is made of magnetic material, said bushing being made of hard material designed to be machined with extreme precision and suitable for a thermal treatment such as to bestow thereon greater resistance to wear and fatigue.

30. A fuel injector for an internal-combustion engine, comprising:

a balanced metering servovalve configured to control a control rod for controlling injection that is mobile along an axial cavity, the balanced metering servovalve including:

an axial stem including an exhaust duct, the exhaust duct having at least one substantially radial stretch that gives out onto a lateral surface of the axial stem;

a valve body including a control chamber having a calibrated inlet for fuel and an outlet passage in communication with the exhaust duct of the axial stem;

a biasing element;

an electro-actuator;

an armature plate controlled by the electro-actuator, the armature plate including an engagement surface;

a bushing separate from the armature plate, the bushing including an open/close element and a projection configured to axially engage the engagement surface of the armature plate, the bushing being mobile along the axial stem and controlled by the armature plate, the bushing being coupled in a fluid-tight way with the axial stem so as to slide axially to move the open/close element between a position of closing and a position of opening of the at least one substantially radial stretch, the open/close element being kept in the closed position by the biasing element; and an intermediate body positioned and configured to bring the open/close element into the closed position when biased by the biasing element, the intermediate body including an engagement member configured to engage the armature plate upon actuation of the electro-actuator to bring the open/close element into the open position, a predetermined axial play being exhibited between the armature plate and the engagement member or the projection to enable a relative axial displacement between the armature plate and the bushing.

* * * * *